US006325419B1

(12) United States Patent
Benneman

(10) Patent No.: US 6,325,419 B1
(45) Date of Patent: Dec. 4, 2001

(54) SUBSTANTIALLY STOCKING-SHAPED PHOTO ALBUM AND METHOD THEREFOR

(76) Inventor: Angeline M. Benneman, 800 Saylor Way, Las Vegas, NV (US) 89107

( * ) Notice: Subject to any disclaimer, the term of this patent is extended or adjusted under 35 U.S.C. 154(b) by 0 days.

(21) Appl. No.: 09/803,121

(22) Filed: Mar. 12, 2001

(51) Int. Cl.[7] ..... B42D 1/08

(52) U.S. Cl. ..... 281/22; 281/31; 281/38; 281/51; 281/29

(58) Field of Search ..... 281/15.1, 16, 21.1, 281/22, 29, 31, 38, 45, 51; 283/117; 402/4, 70, 73; 446/73, 76; 40/124.01

(56) References Cited

U.S. PATENT DOCUMENTS 5,389,028 * 2/1995 Cabrera et al. ..... 446/73
5,592,768 * 1/1997 Testa ..... 40/786
6,224,107 * 5/2001 Smith ..... 281/15.1

* cited by examiner

*Primary Examiner*—Willmon Fridie, Jr.
(74) *Attorney, Agent, or Firm*—Weiss & Moy, P.C.; Jeffrey Weiss; Harry M. Weiss

(57) ABSTRACT

A substantially stocking-shaped photograph album and method therefor, comprising a base portion, at least one substantially stocking-shaped leaf coupled to the base portion, and at least one sleeve coupled to the substantially stocking-shaped leaf, wherein the sleeve is dimensioned to receive a photograph in order to provide a way to store and display photographs in a festive photo album. Preferably, an audio device can be activated to play a melody while viewing the pictures.

20 Claims, 2 Drawing Sheets

SUBSTANTIALLY STOCKING-SHAPED PHOTO ALBUM AND METHOD THEREFOR

FIELD OF THE INVENTION

This invention relates generally to photo albums and methods therefor and, more specifically, to a substantially stocking shaped photo album and method therefor.

BACKGROUND OF THE INVENTION

Photo albums have often been used as a way to store photographs. The photograph album allows the user to place many photographs in an organized fashion. Although the pictures in a photo album can obviously be viewed, picture frames are often preferred when the primary goal is to display the photograph as opposed to merely storing it. However, picture frames, although capable of displaying photos, generally do not offer the ability to store large quantities of photographs.

The holiday season is a time when friends and family are interested in displaying many photos. Christmas time is an especially festive period when many people come together. This time, which is often spent indoors because of the weather as well as a desire to spend quality time with one another, is an ideal time for displaying photos of friends and family.

It is often the case, however, that when a person has many photographs that he or she wishes to display there is no cost-effective way to display all of the photos. Using many picture frames is not only costly but also takes up a lot of space. Putting the photos in an album often means giving up on displaying them for all to see. Some people attempt to solve this problem by leaving a photo album open, thus using it for both storage and display. However, this solution requires a great deal of counter space, which often makes it impractical.

A need therefore existed for a photo album designed for the holiday season, which is also capable of both storing and displaying photographs in a space-saving, festive and attention drawing manner.

SUMMARY OF THE INVENTION

An object of the present invention is to provide a substantially stocking-shaped photo album capable of both storing and displaying photographs in a space-saving and attention-drawing manner.

It is a further object of the present invention to provide a photo album designed for the holiday season having an audio device designed to play a melody.

BRIEF DESCRIPTION OF THE PREFERRED EMBODIMENTS

In accordance with one embodiment of the present invention, a substantially stocking-shaped photo album is disclosed, comprising, in combination, a base portion, at least one substantially stocking-shaped leaf having a top portion and a bottom portion, the top portion of the leaf is coupled to the base portion, and at least one sleeve dimensioned to receive a photograph, the at least one sleeve is coupled to the at least one substantially stocking-shaped leaf.

In accordance with another embodiment of the present invention, a method of displaying pictures is disclosed, comprising, in combination, the steps of providing a base portion, providing at least one substantially stocking-shaped leaf having a top portion and a bottom portion, coupling the top portion of the at least one substantially stocking-shaped leaf to the base portion, providing at least one sleeve dimensioned to receive a photograph, coupling the sleeve to the at least one substantially stocking-shaped leaf, and inserting a picture into the at least one sleeve.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
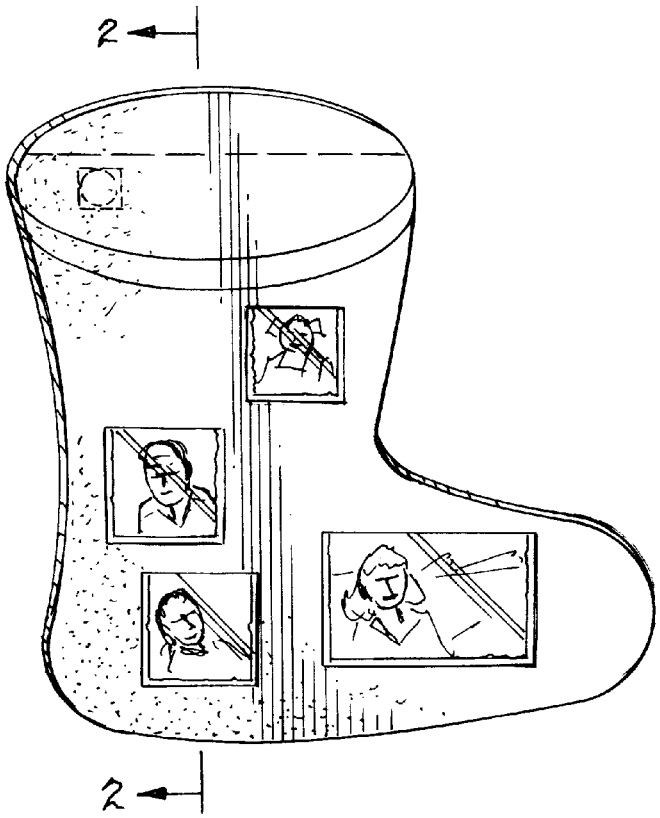
FIG. 1 is a front view of the preferred embodiment of the substantially stocking-shaped photo album of the present invention.
Figure 2:
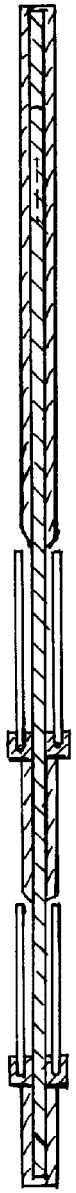
FIG. 2 is a side view taken along line 2—2 of FIG. 1.
Figure 3:
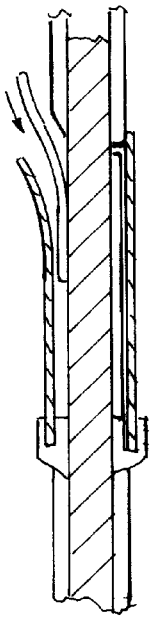
FIG. 3 is a close-up view of FIG. 2, showing a photograph being inserted into a sleeve.

Referring to FIG. 1, reference number 10 refers generally to the preferred embodiment of the substantially stocking-shaped photo album of the present invention. The substantially stocking shaped photo album 10 generally comprises a base portion 12 (shown in FIGS. 1–3), at least one substantially stocking-shaped leaf 14 (shown in FIGS. 1–3) and at least one sleeve 16 (shown in FIGS. 1–3). The at least one leaf 14 has a top portion 18 (shown in FIGS. 1–2) and a bottom portion 20 (shown in FIGS. 1–2). The top portion 18 of the leaf 14 is coupled to the base portion 12. The at least one sleeve 16 is dimensioned to receive a photograph 22. The sleeve 16 is coupled to the leaf 14. Preferably, the sleeve 16 is comprised of a thin, plastic-type transparent material, although it should be clearly understood that any substantially transparent material capable of securely holding a photograph 22, such as glass, is within the spirit and scope of this invention.

In the preferred embodiment the at least one substantially stocking-shaped leaf 14 is approximately 12 inches in length and six inches in width, although it should be understood that substantial benefit could be derived from an alternative configuration of the substantially stocking-shaped photo album 10 in which the at least one substantially stocking-shaped leaf 14 deviates, even substantially, from the preferred dimensions in either direction.

In the preferred embodiment, four sleeves 16 dimensioned to receive photographs 22 are coupled to a front side 24 of the at least one leaf 14, and an additional four sleeves 16 are coupled to a back side 26 (shown in FIGS. 2, 3, 5 and 6) of the at least one leaf 14. While, in the preferred embodiment, four sleeves 16 are coupled to both a front side 24 and a back side 26 of the at least one leaf 14, it should be clearly understood that substantial benefit could be derived from an alternative configuration of the substantially stocking-shaped photo album 10 in which as few as one sleeve 16 is coupled to as few as one side of the at least one leaf 14, for example when one desires to use the album to display a very large picture.

In the preferred embodiment, the base portion 12 comprises an audio device 28 (shown in FIG. 1) designed to play a melody when activated. It should be understood that the audio device 28 may comprised of a semiconductor chip or a miniature playback device with speakers, or some other device capable of producing sound. The audio device 28 is preferably activated when a viewer of the album 10 depresses a button 30. The audio device 28 is preferably designed to play the song "Christmas and Love" (Copyright Registration No. Eu981947), although it should be clearly understood that substantial benefit could be derived from an alternative configuration of the substantially stocking-shaped photo album 10 in which no audio device 28 exists, or in which the audio device 28 plays a song other than, or in addition to, "Christmas and Love."

Figure 4:
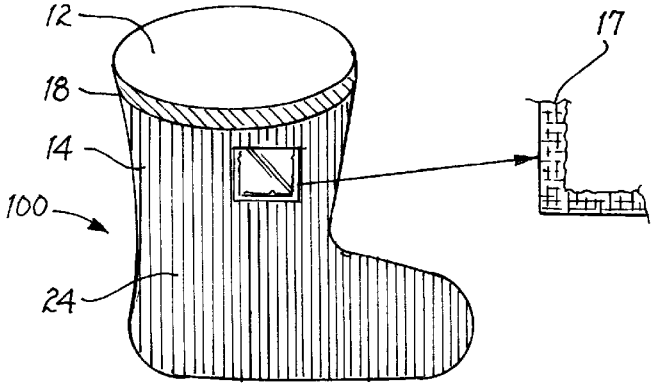
FIG. 4 is a front view of an alternative embodiment of the substantially stocking-shaped photo album, showing the base portion in white with green trim, the leaf portion in red and the border of the sleeve in gold.

Referring now to FIG. 4, an alternative embodiment of the substantially stocking-shaped photo album 10, hereinafter 100, is shown. The substantially stocking-shaped photo album 100 is essentially the same as before, although the base portion 12 is white, the front side 24 of the substantially stocking-shaped leaf 14 is red, the top portion 18 of the leaf 14 is green and a border 17 (shown in a break-away view of FIG. 4) of the sleeve 16 is gold. The purpose of assigning colors to the substantially stocking-shaped photo album 100 is to make the album 100 more festive and appealing to the eye so as to draw viewers to the pictures 22 found within the album 100. For Christmas, the colors listed above could be used, whereas other colors might be more suitable for other holidays. During Christmas time, the base portion 12 of the substantially stocking-shaped photo album 100 may be coupled to a mantle (not shown) next to actual Christmas stockings (not shown). Displaying the photo album 100 in this way saves space and brings attention to the photographs 22 both due to their position as a centerpiece in the room as well as due to the novelty of the photograph album 100. While, in this embodiment, the base portion 12 is white, the top portion 18 of the substantially stocking-shaped leaf 14 is green, the front side 24 of the substantially stocking-shaped leaf 14 is red, and the border 17 of the sleeve 16 is gold, it should be clearly understood that substantial benefit could be derived from an alternative configuration of the substantially stocking-shaped photo album 100 in which alternative colors are assigned to the various components of the photo album 100.

Figure 5:
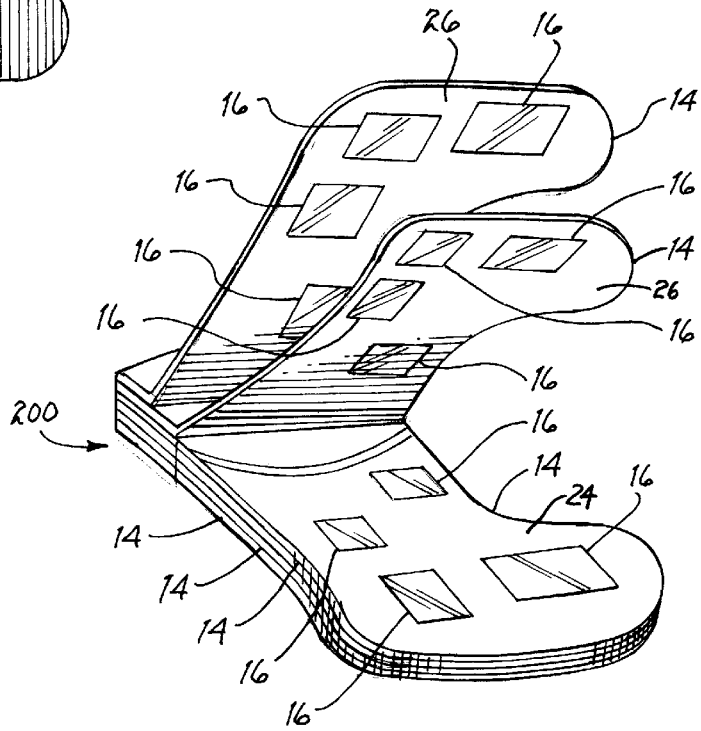
FIG. 5 is a perspective view of an alternative embodiment of the substantially stocking-shaped photo album.
Figure 6:
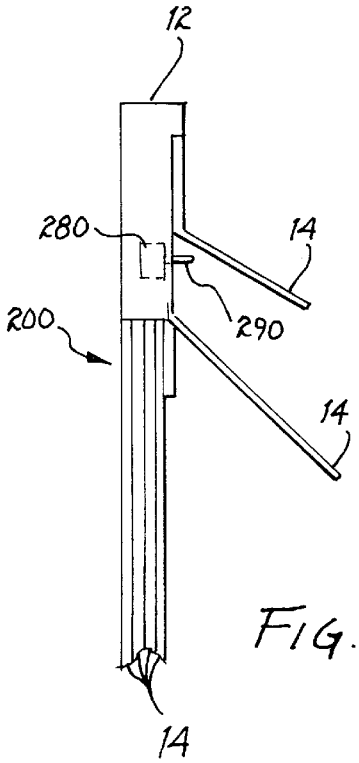
FIG. 6 is a side view of the substantially stocking-shaped photo album of FIG. 5.

Referring now to FIGS. 5–6, an alternative embodiment of the substantially stocking-shaped photo album 10, hereinafter 200, is shown. The substantially stocking-shaped photo album 200 is essentially the same as before, although six leaves 14 are used, each leaf holding four sleeves 16 on the front side 24 and four sleeves 16 on the back side 26 for a total of eight possible pictures 22 per leaf 14, and a grand total of 48 pictures 22 for a six-leaf photograph album. The substantially stocking-shaped photo album 200 also preferably comprises an alternative configuration of the audio device 28, hereinafter 280 (shown in FIG. 6). The audio device 280 is essentially the same as before, although the audio device 280 comprises a pressure-sensitive activation device 290 designed to activate the audio device 280 when one of the substantially stocking-shaped leaves 14 is raised by the viewer. In this embodiment, as soon as a viewer lifts up one of the leaves 14 to view additional pictures 22, the pressure sensitive activation device 290 activates the audio device 280, producing a melody. While, in this embodiment, the substantially stocking-shaped photo album 200 comprises both an audio device 280 as well as six substantially stocking-shaped leaves 14, it should be clearly understood that substantial benefit could be derived from an alternative configuration of the substantially stocking shaped photo album 200 in which as few as one leaf 14 is used with an audio device 280 or in which six leaves 14 are used without an audio device 280.

While the invention has been particularly shown and described with reference to preferred embodiments thereof, it will be understood by those skilled in the art that the foregoing and other changes in form and details may be made therein without departing from the spirit and scope of the invention.

I claim:

1. A substantially stocking-shaped photo album, comprising, in combination:

a base portion;

at least one substantially stocking-shaped leaf having a top portion and a bottom portion, said top portion of said leaf is coupled to said base portion; and at least one sleeve dimensioned to receive a photograph, said at least one sleeve is coupled to said at least one substantially stocking-shaped leaf.

2. The album of claim 1 further comprising six leaves coupled to said base portion.

3. The album of claim 1 further comprising a plurality of sleeves dimensioned to receive a photograph coupled to a front side of said at least one leaf and a plurality of sleeves coupled to a back side of said at least one leaf.

4. The album of claim 1 further comprising four sleeves dimensioned to receive a photograph coupled to a front side of said at least one substantially stocking-shaped leaf.

5. The album of claim 4 further comprising four sleeves dimensioned to receive a photograph coupled to a back side of said at least one substantially stocking-shaped leaf.

6. The album of claim 1 wherein a border of said at least one sleeve comprises a first color, said at least one leaf comprises a second color, and said base portion comprises a third color.

7. The album of claim 1 further comprising:

an audio device designed to play a melody when activated, said audio device is coupled to said base portion.

8. The album of claim 7 wherein said audio device is activated by depressing a button.

9. The album of claim 7 further comprising a pressure sensitive activation device coupled to said audio device and designed to activate said audio device when said at least one substantially stocking-shaped leaf is raised.

10. The album of claim 1 wherein said at least one substantially stocking-shaped leaf is approximately 12 inches in length and six inches in width.

11. A method of displaying pictures comprising, in combination, the steps of:

providing a base portion;

providing at least one substantially stocking-shaped leaf having a top portion and a bottom portion;

coupling said top portion of said at least one substantially stocking-shaped leaf to said base portion;

providing at least one sleeve dimensioned to receive a photograph;

coupling said sleeve to said at least one substantially stocking-shaped leaf; and inserting a picture into said at least one sleeve.

12. The method of claim 11 further comprising the step of providing six leaves coupled to said base portion.

13. The method of claim 11 further comprising the step of providing a plurality of sleeves dimensioned to receive a photograph coupled to a front side of said at least one leaf and a plurality of sleeves coupled to a back side of said at least one leaf.

14. The method of claim 11 further comprising the step of providing four sleeves dimensioned to receive a photograph coupled to a front side of said at least one substantially stocking-shaped leaf.

15. The method of claim 14 further comprising the step of providing four sleeves dimensioned to receive a photograph coupled to a back side of said at least one substantially stocking-shaped leaf.

16. The method of claim 11 wherein a border of said at least one sleeve comprises a first color, said at least one leaf comprises a second color, and said base portion comprises a third color.

17. The method of claim 11 further comprising the step of providing an audio device designed to play a melody when activated, said audio device is coupled to said base portion.

18. The method of claim 17 further comprising the step of depressing a button to activate said audio device.

19. The method of claim 17 further comprising the steps of:

providing a pressure-sensitive activation device designed to activate said audio device, said pressure-sensitive activation device is coupled to said audio device; and raising said at least one substantially stocking-shaped leaf to activate said pressure-senstitive activation device.

20. The method of claim 11 wherein said at least one substantially stocking-shaped leaf is approximately 12 inches in length and six inches in width.

* * * * *